US006825576B1

(12) United States Patent
Blackburn et al.

(10) Patent No.: US 6,825,576 B1
(45) Date of Patent: Nov. 30, 2004

(54) METHOD AND APPARATUS FOR PREVENTING STALL IN A STARTER/ ALTERNATOR EQUIPPED I.C. ENGINE SYSTEM

(75) Inventors: Scott Evart Blackburn, Temperance, MI (US); Eric Keith Manning, Toledo, OH (US)

(73) Assignee: Dana Corporation, Toledo, OH (US)

( * ) Notice: Subject to any disclaimer, the term of this patent is extended or adjusted under 35 U.S.C. 154(b) by 58 days.

(21) Appl. No.: 10/173,303

(22) Filed: Jun. 18, 2002

(51) Int. Cl.[7] ..... F02N 11/06; F02N 11/04

(52) U.S. Cl. ..... 290/40 A; 290/40 R; 290/40 B; 290/36 R; 290/37 A

(58) Field of Search ..... 290/40 A, 40 R, 290/40 B, 37 A, 41, 40 C, 30 R–38 R

(56) References Cited

U.S. PATENT DOCUMENTS

| | | | | | |
|---|---|---|---|---|---|
| 4,463,305 | A | * | 7/1984 | Wineland et al. | 322/10 |
| 4,510,396 | A | * | 4/1985 | Uchida et al. | 290/30 R |
| 4,553,516 | A | | 11/1985 | Hasegawa | |
| 4,633,093 | A | | 12/1986 | Otobe et al. | |
| 4,721,083 | A | | 1/1988 | Hosaka | |
| 4,794,898 | A | | 1/1989 | Kato | |
| 5,075,616 | A | * | 12/1991 | Mitsui | 322/10 |
| 5,323,101 | A | | 6/1994 | Pierret et al. | |
| 5,495,127 | A | * | 2/1996 | Aota et al. | 290/31 |
| 5,561,330 | A | * | 10/1996 | Crook | 290/30 R |
| 5,601,058 | A | * | 2/1997 | Dyches et al. | 123/179.2 |
| 5,681,495 | A | | 10/1997 | Tsuchiya et al. | |
| 5,712,786 | A | | 1/1998 | Ueda | |
| 5,743,227 | A | * | 4/1998 | Jacquet et al. | 123/179.3 |
| 5,771,478 | A | * | 6/1998 | Tsukamoto et al. | 701/68 |
| 6,121,691 | A | * | 9/2000 | Renner | 290/40 A |
| 6,323,562 | B1 | * | 11/2001 | Renner et al. | 290/38 A |
| 6,326,702 | B1 | * | 12/2001 | Yonekura et al. | 290/40 C |
| 6,516,253 | B2 | * | 2/2003 | Boggs et al. | 701/20 |
| 6,603,213 | B1 | * | 8/2003 | Renner | 290/1 A |
| 2001/0004203 | A1 | * | 6/2001 | Matsubara et al. | 322/16 |
| 2002/0093202 | A1 | * | 7/2002 | Downs et al. | 290/40 R |

FOREIGN PATENT DOCUMENTS

| | | | | |
|---|---|---|---|---|
| JP | 58030424 | * | 2/1983 | F02D/5/02 |

* cited by examiner

*Primary Examiner*—Nicholas Ponomarenko
*Assistant Examiner*—Heba Elkassabgi
(74) *Attorney, Agent, or Firm*—Liniak, Berenato & White

(57) ABSTRACT

A method and apparatus for preserving a starter/alternator in an I.C. engine system installation from repeated operation in the starter mode by detecting and preventing an I.C. engine stall by disabling the generator function of the starter/alternator. The system describes a method of comparing the detected rotational speed of the starter/alternator in generator mode with a reference rotational incipient stall speed of the system I.C. engine. If the I.C. engine speed falls below a threshold stall speed, the generator function of the starter/alternator is disabled. In addition, a second detected speed of the I.C. engine is detected following the disabling of the generator function to determine if the I.C. engine has resumed an engine speed above a second threshold speed, whereupon the generating function is restored.

4 Claims, 3 Drawing Sheets

METHOD AND APPARATUS FOR PREVENTING STALL IN A STARTER/ ALTERNATOR EQUIPPED I.C. ENGINE SYSTEM

FIELD OF THE INVENTION

The invention relates to the field of automotive electrical systems. Specifically, the invention is directed to a method and apparatus for preventing a stall condition in a starter/alternator equipped I.C. engine system.

BACKGROUND OF THE INVENTION

A recent trend in automotive electrical systems is the combining of the formerly separately functioning and operating starter and alternator/generator components. As automobiles become more electronics intensive, in terms of electronic accessories and sophistication of control systems, the need becomes greater for increased electrical supply. As a result, the alternator has become physically larger and more powerful as automotive electrical needs have increased.

In addition, the need for increasing operating efficiencies from I.C. engines mandates a powerful and frequently operated starter motor to resume I.C. engine operation on short demand cycles. And, while these separate trends have been in place, a third element always present in automotive design is packaging efficiency in terms of underhood space. As these trends have progressed, a commonly proposed strategy is to combine the starter and alternator/generator into a single underhood element. In this regard, the starter function of the starter/alternator can be quite powerful vis-à-vis the I.C. engine being started inasmuch as the I.C. engine is required to achieve self-sustaining operation within ½ to 1 second of starter initiation. Likewise, the generator function of the starter/alternator can be equally powerful vis-à-vis the capacity of the I.C. engine to generate sufficient torque especially during instances of high relative load and low relative engine speed. In this instance, a stall condition of the I.C. engine can quickly arise if the load generated by the generating function of the starter/alternator is allowed to overwhelm the torque supplied by the I.C. engine. This situation can be unsafe in circumstances where restarting the I.C. engine from a static condition is unfavorable (i.e. a high heat, high load condition). In addition, if the stall condition is repeated successively followed by I.C. engine restart sequences, the starter/alternator can quickly overheat and become inoperable.

SUMMARY OF THE INVENTION

The present invention is directed to solving at least one of the potential problems associated with the trend towards combined starter and generator/alternator functions. Specifically, the present invention proposes a method and associated apparatus for sensing an incipient stall condition of the I.C. engine system equipped with a starter/alternator. When a stall onset is detected, the present method disables the generating function of the starter/alternator to restore sufficient I.C. engine speed to eliminate the stall condition. Thereafter, when sufficient I.C. engine speed is detected, the generating function is restored to the starter/alternator. The stall condition can be sensed either directly from a rotation and/or position sensor mounted to the starter/alternator or, alternatively, the stall condition can be sensed from another I.C. engine driven accessory similarly equipped with a rotation and/or speed sensor. Such an accessory may include, but not be limited to, an engine driven cooling fan, the waterpump, A/C compressor, power steering pump, or I.C. engine camshaft. According to the present invention, the stall condition is prevented resulting in continuity of I.C. engine operation and also resulting in preservation of the starter/alternator from excessive use in the starter mode.

DETAILED DESCRIPTION

Figure 1:
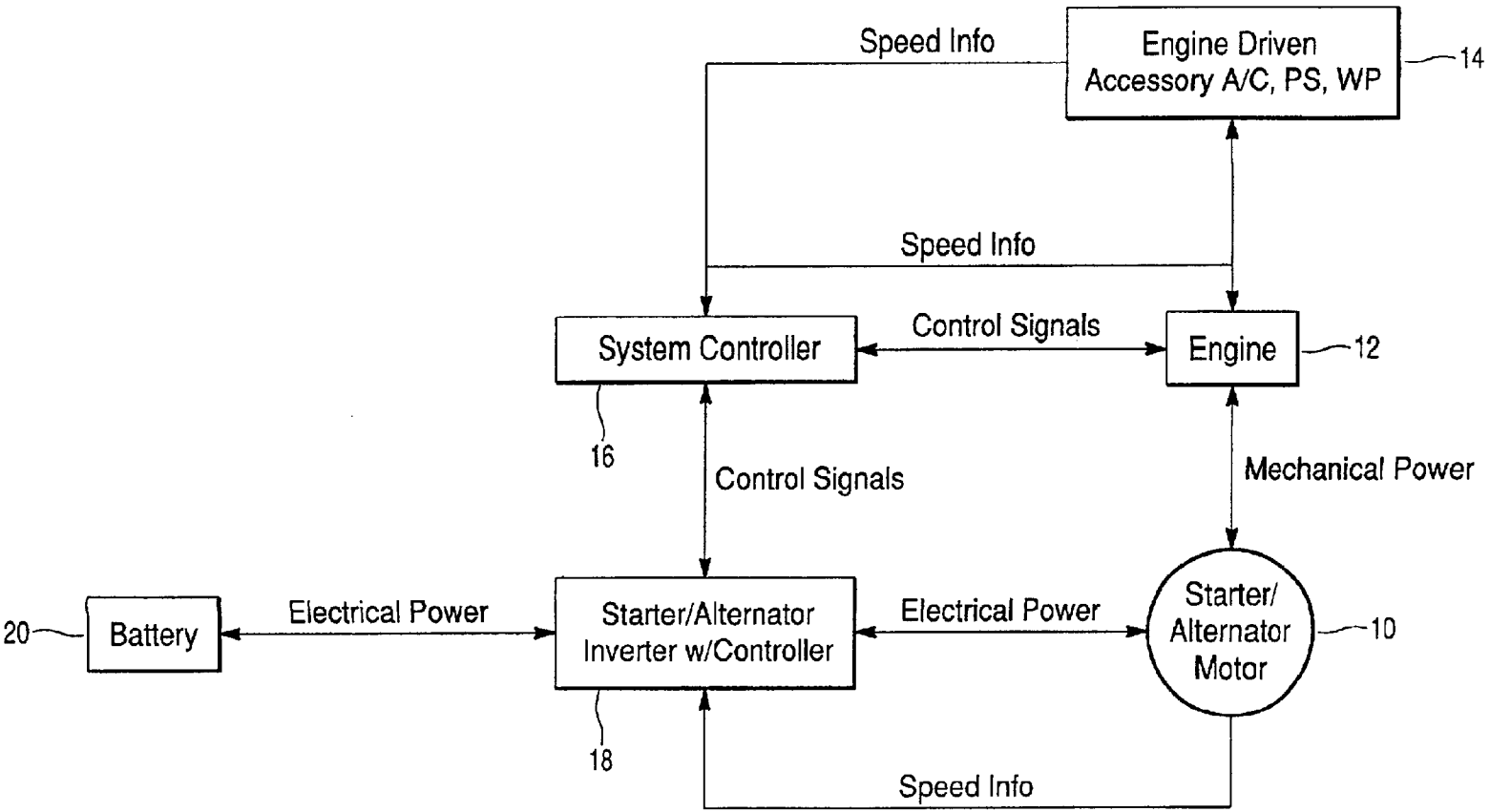
FIG. 1 shows a block diagram embodiment of the necessary sensors and hardware to accomplish the present invention.

The invention is directed to a method of controlling a starter/alternator 10 in an I.C. engine installation and is specifically directed to disabling the generating function when an incipient stall condition for the I.C. engine has been detected. The starter/alternator 10 may be an integrated unit, i.e., in combination with the crankshaft mounted flywheel or balancer, or a separate belt, chain, or gear driven/driving unit. In any configuration, the unit 10 is used to start the I.C. engine according to a predetermined instruction, i.e., operator or accessory load demand, and is used to provide electrical power for either immediate consumption or for storage, i.e., battery charging. The alternator/starter 10 is directly coupled for rotation with the engine 12. The engine is equipped with various sensors for determining rotational speed, temperature, crank position, cam position, etc., and provides this information to a system controller 16, or other designated controller connected into the system. The controller 16 likewise receives and transmits operational information to and from the starter/alternator inverter having an associated controller to selectively choose either the starter or alternator function for the starter/alternator 10. A battery 20 is also a part of the system to provide electrical power to activate the starter/alternator when the starter function is selected. The engine 12 is also equipped with various engine driven accessories 14, for example, cooling fan, A/C, power steering, water pump, emissions pumps, camshaft, etc.

Figure 3:
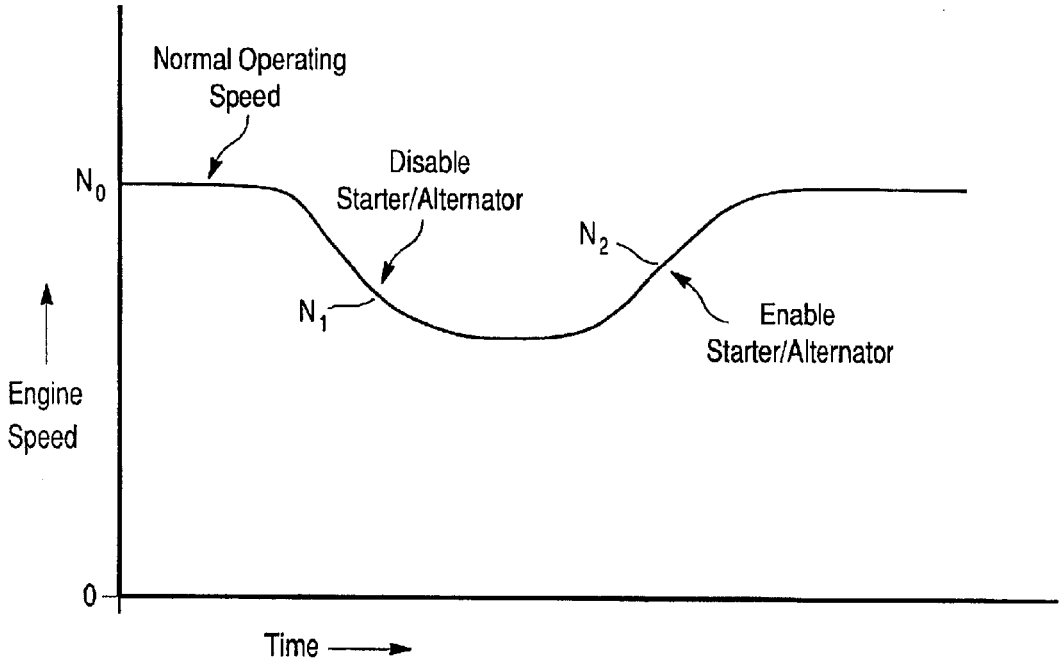
FIG. 3 shows a graphical depiction of a plotted operational chart for disabling and resuming the generating function of the starter/alternator based on detected I.C. engine speed.

In the event the engine 12 is detected to be in an incipient stall condition following a predetermined detecting sequence initiated by the system controller 16, the generating function of the starter/alternator is disabled. The incipient stall condition of the I.C. engine 12 could be from a variety of systems faults, i.e., high load, intermittent fuel, ignition or injection malfunction, or low battery. Regardless, however, if the I.C. engine rotational speed falls below a predetermined threshold speed N−1 (see FIG. 3) from a normal operating condition N-o, the system controller 16 disables the generating function of the starter/alternator 10. When the I.C. engine rotational speed begins to increase beyond a threshold N−2, the system controller reactivates the generator function of the starter/alternator 10.

Figure 2:
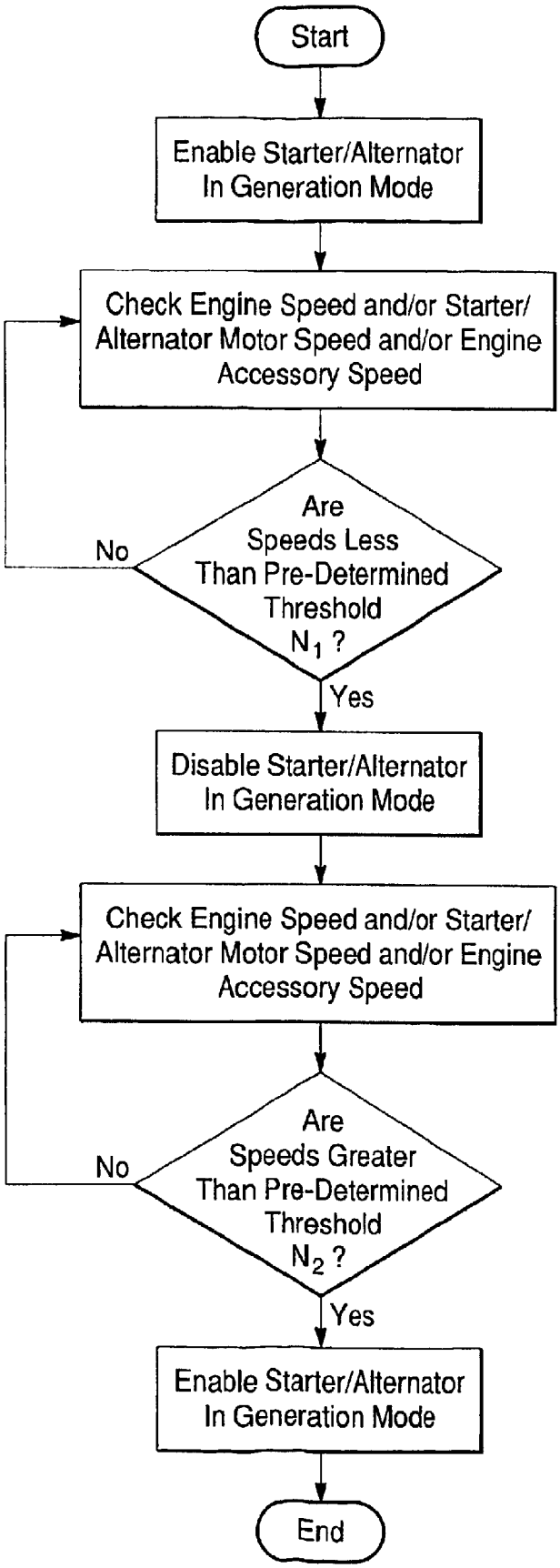
FIG. 2 shows a flow chart of decision making for the method used by the system controller to determine an I.C. engine stall condition and disable the generating function as necessary.

FIG. 2 shows a block diagram for the logic sequence of the system controller 16 in using the method of the present invention. The generating mode of the starter/alternator is initially engaged. Thereafter the speed of the I.C. engine is detected and compared to a threshold speed N−1. If the detected I.C. engine speed falls below the threshold speed N−1, the system controller 16 disables the starter/alternator in the generating mode. Thereafter the I.C. engine speed is detected and again compared to a threshold speed N−2 for resumption of the generating mode of the starter/alternator. If the I.C. engine speed remains below the threshold speed N−2, the generating function of the starter/alternator remains disabled. If the detected I.C. engine speed is above the threshold speed N−2 the generating function of the starter/alternator is re-engaged.

The engine speed in the present method can be checked either by a direct check on the speed of the starter/alternator or by checking any engine driven component equipped with rotational speed and/or position sensors (taking into account speed differences with the engine and starter/alternator owing to pulley ratios, gear drive ratios, etc.). A comparison is then made to determine if the detected I.C. engine speed has exceeded or falls below a predetermined acceptable rpm range for either of N−1 or N−2 depending on which step of the method is being executed. If the speed is lower, the starter/alternator can continue in a disabled generating mode, if higher, the generating mode can be re-engaged. The starter/alternator 10 used in the present invention can be of the switched reluctance type or other microprocessor controlled starter/alternator where re-engaging and disengaging the generating function can take place in microseconds according to the control signals received from system controller 16.

The foregoing method will improve the performance and overall reliability of the starter/alternator system by controlling and limiting excessive use of the starter/alternator in starter mode owing to repeated I.C. engine stall cycles. In accordance with the method, the starter/alternator system is preserved from destructive excessive operation. The specific limitations and parameters in the present inventive method and apparatus for what is considered an incipient stall condition, i.e., N−1, and sufficient I.C. engine speed to resume generator function, i.e., N−2, is dependent upon the design criteria of the starter/alternator system and associated I.C. engine. For example, the relative size, cylinder configuration, and torque generating capacity of the I.C. engine, the size, torque absorbing capacity of the starter/alternator in generating mode, and expected operational criteria of the I.C. engine taking into account ambient conditions (i.e., how hot/cold, humid/dry, air pressure/density, etc.). For example, an in-line 6 cylinder turbo diesel type I.C. engine of 3 liter displacement would have an incipient stall rpm (450 rpm) very different from a 3 cylinder alcohol fueled I.C. engine of 900 cc capacity (800 rpm) that, in turn, would have a very different incipient stall rpm from a small displacement two-stroke type I.C. engine (1100 rpm). Regardless of design parameters, however, the applied method would follow the necessary detecting and comparison steps according to the predetermined criteria specified for the starter/alternator and associated I.C. engine.

Additional modifications and uses of the present method will occur to those of ordinary skill in the field upon reading of the foregoing specification and accompanying drawings. These descriptions of the invention herein are not to be considered limiting except as to the claims that follow.

We claim:

1. A method of preventing a stall condition of an I.C. engine system equipped with a microprocessor controlled starter/alternator operating in generator mode for generating electrical power, comprising the steps of:

enabling said generator mode of said starter/alternator;

detecting a rotational speed of said I.C. engine and obtaining a first detected speed;

comparing said first detected speed with a first predetermined acceptable threshold rotational speed of said I.C. engine representative of incipient stall of said I.C. engine; and, disabling said starter/alternator in said generator mode when said detected speed falls below said predetermined acceptable threshold rotational speed, thereby preventing said I.C. from stalling and ceasing to operate owing to excessive generator load.

2. A method as in claim 1, further comprising:

detecting a second rotational speed of said I.C. engine following said disabling step and obtaining a second detected speed;

comparing said second detected speed to a second predetermined acceptable threshold rotational speed; and, re-enabling said generator mode of said starter/alternator when said second detected speed exceeds said predetermined acceptable threshold, thereby allowing said I.C. engine to continue operating.

3. A method as in claim 1, wherein:

said detecting step for said I.C. engine rotational speed is accomplished using a detected rotational speed of said starter/alternator, said detected rotational speed being detected directly from said starter/alternator.

4. A method as in claim 1, wherein:

said detecting step for said I.C. engine rotational speed is accomplished using a detected rotational speed of an I.C. engine driven accessory.

* * * * *